United States Patent [19]

Giler

[11] 4,262,192

[45] Apr. 14, 1981

[54] MOLYBDENUM DISILICIDE RESISTANCE WIRE AND SUPPORT

[75] Inventor: Roger R. Giler, Wilton, Conn.

[73] Assignee: The Kanthal Corporation, Bethel, Conn.

[21] Appl. No.: 66,680

[22] Filed: Aug. 15, 1979

[51] Int. Cl.[3] ..... H05B 3/06

[52] U.S. Cl. ..... 219/542; 219/464; 219/536; 219/552; 13/25

[58] Field of Search ..... 219/463, 464, 532, 536, 219/542, 552; 13/22, 25; 338/244, 268

[56] References Cited

U.S. PATENT DOCUMENTS

| | | | |
|---|---|---|---|
| 3,121,154 | 2/1964 | Menzies et al. | 219/542 X |
| 3,373,239 | 3/1968 | Rubisch | 13/25 |
| 3,612,829 | 10/1971 | Evans et al. | 219/464 |
| 3,641,249 | 2/1972 | Higgins | 13/22 |
| 3,749,883 | 7/1973 | Vodvarkia et al. | 219/463 |
| 3,833,793 | 9/1974 | McWilliams et al. | 219/464 |
| 3,912,905 | 10/1975 | Giler | 219/464 |
| 4,161,648 | 7/1979 | Gössler | 219/464 |

*Primary Examiner*—Volodymyr Y. Mayewsky
*Attorney, Agent, or Firm*—Kenyon & Kenyon

[57] ABSTRACT

A molybdenum disilicide electric resistance wire powered to heat to temperatures of from 2000° to 2600° F. has one or more supports directly contacting the resistance wire and made of an Fe-Cr-Al alloy having its surface covered by oxide preventing chemical reaction between the wire and the support.

3 Claims, 3 Drawing Figures

1
6
7
8
7a
8a
8b

MOLYBDENUM DISILICIDE RESISTANCE WIRE AND SUPPORT

BACKGROUND OF THE INVENTION

As shown by the U.S. Pat. No. Giler 3,912,905, the use of a molybdenum disilicide resistance wire heating element for a cooking stove hot plate of the glass-top type, is advantageous because when initially powered the resistance wire substantially instantaneously becomes incandescent.

By appropriate proportioning of the resistance wire diameter-to-length factors, the wire can be made to operate at temperatures upwardly from 2000° F. to a service maximum in the area of 2600° F. or possibly higher. Consequently, it is possible to provide an excellent source of thermal radiation for heating a cooking utensil on the glass plate spaced above the heating element.

The Giler patent suggests that the molybdenum disilicide wire element be formed either sinuously or in the form of a spiral with the wire held by being fused to refractory fibers fluffed up from the surface of the usual pad spaced below the glass under the element and made of refractory fibrous material, such as is sold under the tradename "FIBERCHROME" by Johns-Manville. Compacted fibrous refractory pad material is available from other manufacturers under various tradenames.

To more firmly anchor the molybdenum disilicide wire on the refractory fibrous pad, the use of hooks or staples is suggested, made of molybdenum disilicide wire.

The reason for the above is that the prior art has found that molybdenum disilicide wire supports made of metal alloys, normally adapted for elevated temperature service, result in a reaction between the alloy and the molybdenum disilicide when the latter is operating at temperatures of from 2000° to 2600° F., for example.

The use of molybdenum disilicide wire for making staples, loops and the like for supporting the molybdenum disilicide resistance wire has the disadvantage that this compound can be bent only when heated to the high temperature making the material malleable and ductile enough to be bent to the required shapes. This involves a substantial manufacturing cost, and if used in connection with the manufacture of a glass-top electric resistance heater to be incorporated into an electric stove construction, the hot plate overall cost becomes too high relative to other kinds of electric hot plates.

SUMMARY OF THE INVENTION

The present invention is based on the discovery that Fe-Cr-Al electric resistance alloy wire can be used to support the molybdenum disilicide wire resistance element, with the resistance wire and support wire directly intercontacting, if such support wire is first coated or covered by a layer of oxide obtained by heating the support wire to temperatures above 1800° F. in air. The aluminum of such an alloy combines with the oxygen in the air and forms tightly adherent alumina coating or covering which prevents the usual reaction between the molybdenum disilicide and the metal alloy wire. Furthermore, it has been found that this oxide coating does not flake off when the Fe-Cr-Al wire is bent as required to form staples of various shapes having legs which can be pushed into the usual or a rigidized refractory fibrous pad, or if the shapes are first bent to form and then oxidized, as might occur during handling of the shapes or insertion of the legs in the pad.

DESCRIPTION OF THE DRAWINGS

The principles of the invention are illustrated by the accompanying drawings in which.

DETAILED DESCRIPTION OF THE INVENTION

Figures 1, 2, 3:
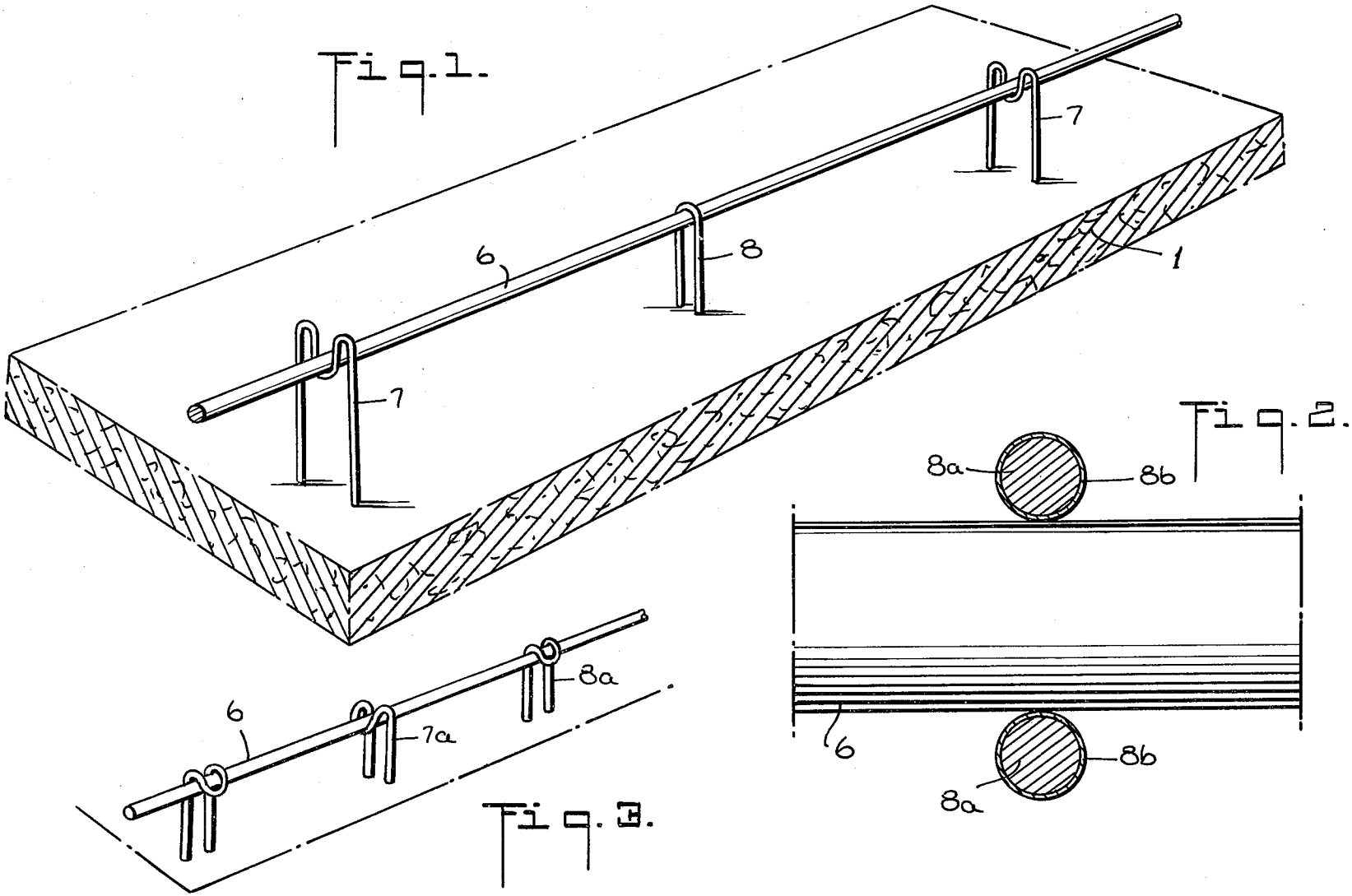
FIG. 1 is a perspective view showing a molybdenum disilicide wire supported in spaced relationship to a refractory fibrous pad.
FIG. 2 on an enlarged scale shows a cross section of the support wire in contact with the molybdenum disilicide.
FIG. 3 is a perspective view showing a modification.

Having reference to the above drawings, FIG. 1 shows a support 1 formed by a portion of what can be the fibrous refractory material pad illustrated by the Giler patent, excepting that the surface need not be roughened to provide fuzziness. A short length of molybdenum disilicide resistance wire is shown at 6 and this can be a part of an overall length and having either of the shapes shown by the Giler patent, but in the present instance, the resistance wire does not rest directly on the pad.

Instead, the molybdenum disilicide wire 6 is spaced above the pad by a saddle 7 and prevented from falling from the saddle 7 if the assembly is inverted, by hairpin loops 8. The saddles and hairpins can be provided in any number required to support the resistance wire, and these supporting parts could be made from molybdenum disilicide wire. However, molybdenum disilicide wire is produced in straight lengths and its use would necessitate heating of the wire to the high temperatures necessary to make it malleable and ductile, together with careful bending operations which would have to be performed manually, all of this representing undesirable expense.

According to this invention, electric resistance wire of the Fe-Cr-Al type is used. Assuming that the molybdenum disilicide wire 6 has a diameter ranging from 0.018" to 0.04", a 0.024" diameter having been used in connection with practicing the present invention, the support wire can be 26 gauge or, in other words, 0.0159" in diameter. It should have a smaller diameter than the resistance wire and should be as small as possible consistent with the stiffness required to support the molybdenum disilicide wire. The straight legs shown should be stiff enough to be pushed into the pad.

Electric resistance alloy wire of the Fe-Cr-Al type typically comprise from 15 to 37% chromium and from 5 to 7% aluminum with the balance, of course, being iron. The wire is malleable and/or ductile enough to be bent and it can be formed into the saddle and hairpin shapes or other shapes considered desirable for spacing the molybdenum disilicide wire 6 above the pad 1, as for example, a distance of about $\frac{1}{8}$". Conventional automatic wire stapling tools can be used when modified to provide the desired shape of wire support, and the tools can be used to drive the staples into the pad 1, the supports having the straight legs typical of staples in general.

Preferably after the supports are bent to shape as desired, they are heated in air to at least 1800° F. for an adequate time to form the oxide layer, in the form of alumina, which has been found to prevent the reaction between the metal alloy and the molybdenum disilicide, otherwise to be expected from prior art experience. Preferably the wire supports are bent to the desired forms and are heated in an air furnace for about one hour at 2000° F. so that their entireties, including their legs, are oxidized. As illustrated on an enlarged scale by FIG. 2, this coats the metal alloy 8*a* with an oxide 8*b* which completely covers the metal alloy component. The actual thickness of the oxide covering is not believed at this time to be of importance providing it functions to completely separate the metal alloy components 8*a* from the molybdenum disilicide wire 6 so as to prevent what would otherwise be the usual reaction between the metal alloy and the molybdenum disilicide when the latter is at temperatures of 2000° F. and over. When reducing this invention to actual practice, the resistance wire was operated at 2500° F. for prolonged periods of time without any evidence of a reaction occurring between the wire 6 and supports 8.

Of the various types of Fe-Cr-Al resistance alloys commercially available, it is preferable to choose one having an aluminum content of about 5% or greater. Sometimes such alloys have included cobalt in small amounts of around 3% and this does not interfere with the practice of the present invention. Such electric resistance alloys, as used for the supports 7 and 8, in standard sizes are recommended for use at temperatures from 2000° to 2500° F. When used with the oxide surface of the present invention, however, operation of the molybdenum disilicide wire 6 at a temperature of 2600° F. has been satisfactory.

Although the wire supports probably are heated to as high as 2200° F. when the molybdenum disilicide wire is at 2600° F. where there is direct intercontact, the support wire can be made with such a small diameter that it is not a very effective heat conductor, the temperature of the wire legs dropping rapidly to that of the pad 1 which is relatively cool by comparison with the resistance wire temperature. When the pad 1 is made of any of the usual pad materials, its top surface has been found to be an effective upward reflector of the thermal energy radiated to it by the resistance wire, when the resistance wire is operating at temperatures above 2000° F. and particularly when at a temperature of around 2400° F.

It has been found that the oxide layer 8*b* does not rupture, crack or fragment when the oxidized metal alloy wire is bent. Therefore, it is possible to oxidize the metal alloy wire first and thereafter bend it as required to form the resistance wire supports.

The staple modification shown by FIG. 3 is suggested because as can be seen, the same shape may be used throughout the assembly. By installing this form with the legs in a plane at a right angle to the wire 6, the function of the saddle 7 is performed as shown at 7*a*, and with the legs in a plane parallel to the wire 6, the function of the hairpin loop 8 is performed as shown at 8*a*.

What is claimed is:

1. An electric resistance heating assembly comprising an electrically non-conductive support structure, a molybdenum disilicide resistance wire adapted to heat to a temperature of at least 2000° F., and a plurality of interspaced wire supports holding said resistance wire at a position spaced from and free from contact with said support structure, said wire supports being each formed from an iron-chromium-aluminum alloy wire shaped so as to form at least one loop holding said resistance wire and supporting legs extending from the loop to a connection with said non-conductive support, said legs extending from said loop to said non-conductive support in open air space, the aluminum content of said alloy wire providing for protection against chemical reaction between the alloy wire and said resistance wire at elevated temperatures said alloy wire having an aluminum content of at least 5% and having been preheated in air at a temperature of at least 1800° F. so as to preform an oxide layer on the alloy wire and providing said protection.

2. The assembly of claim 1 in which the diameter of said alloy wire is less than the diameter of said resistance wire so as to reduce heat conductivity through the legs from the resistance wire to said support structure.

3. The assembly of claims 1 or 6 in which said support structure is made of refractory fibrous material and said legs are connected with the support structure by being pushed into the fibrous material.

* * * * *